US011041222B2

(12) United States Patent
Fischer et al.

(10) Patent No.: US 11,041,222 B2
(45) Date of Patent: Jun. 22, 2021

(54) NON-ORIENTED ELECTRICAL STEEL STRIP FOR ELECTRIC MOTORS

(71) Applicants: ThyssenKrupp Steel Europe AG, Duisburg (DE); thyssenkrupp AG, Essen (DE)

(72) Inventors: Olaf Fischer, Bochum (DE); Sebastian Sieron, Essen (DE); Silke Strauss, Hunxe (DE); Karl Telger, Coesfeld (DE); Marco Tietz, Dusseldorf (DE); Anton Vidovic, Essen (DE)

(73) Assignee: thyssenkrupp AG, Essen (DE)

( * ) Notice: Subject to any disclaimer, the term of this patent is extended or adjusted under 35 U.S.C. 154(b) by 0 days.

(21) Appl. No.: 16/609,636

(22) PCT Filed: May 11, 2018

(86) PCT No.: PCT/EP2018/062185
§ 371 (c)(1),
(2) Date: Oct. 30, 2019

(87) PCT Pub. No.: WO2018/210690
PCT Pub. Date: Nov. 22, 2018

(65) Prior Publication Data

US 2020/0063229 A1 Feb. 27, 2020

(30) Foreign Application Priority Data

May 15, 2017 (DE) ..... 10 2017 208 146.5

(51) Int. Cl.
*C21D 8/12* (2006.01)
*C22C 38/02* (2006.01)
*C22C 38/04* (2006.01)
*C22C 38/06* (2006.01)

(52) U.S. Cl.
CPC ..... *C21D 8/1222* (2013.01); *C21D 8/1233* (2013.01); *C21D 8/1261* (2013.01); *C21D 8/1272* (2013.01); *C22C 38/02* (2013.01); *C22C 38/04* (2013.01); *C22C 38/06* (2013.01)

(58) Field of Classification Search
CPC ..... C21D 8/12; C21D 8/1222; C21D 8/1233; C21D 8/1261; C21D 8/1272; C22C 38/001; C22C 38/002; C22C 38/004; C22C 38/02; C22C 38/04; C22C 38/06; C22C 38/14; H01F 1/16
See application file for complete search history.

(56) References Cited

U.S. PATENT DOCUMENTS

| | | | | |
|---|---|---|---|---|
| 6,582,528 | B1 | 6/2003 | Böhm et al. | |
| 2002/0043299 | A1 * | 4/2002 | Tanaka | C22C 38/002 148/111 |
| 2003/0188805 | A1 | 10/2003 | Friedrich et al. | |
| 2005/0247373 | A1 | 11/2005 | Hammer et al. | |
| 2014/0083573 | A1 | 3/2014 | Dorner et al. | |
| 2014/0227127 | A1 | 8/2014 | Natori et al. | |
| 2016/0203897 | A1 | 7/2016 | Dorner et al. | |
| 2017/0194082 | A1 | 7/2017 | Murakami et al. | |
| 2017/0260600 | A1 | 9/2017 | Okubo et al. | |
| 2018/0002776 | A1 | 1/2018 | Kano et al. | |

FOREIGN PATENT DOCUMENTS

| | | | | |
|---|---|---|---|---|
| CN | 1278016 | A | 12/2000 | |
| CN | 103842544 | A | 6/2014 | |
| CN | 106574334 | A | 4/2017 | |
| CN | 106661686 | A | 5/2017 | |
| CN | 107208220 | A | 9/2017 | |
| CN | 109849300 | A | 6/2019 | |
| EP | 2612942 | B1 | 10/2014 | |
| EP | 2840157 | A1 | 2/2015 | |
| JP | 11222653 | A * | 8/1999 | C21D 8/1272 |
| JP | H11222653 | A | 8/1999 | |
| JP | 2001073098 | A | 3/2001 | |
| JP | 2001073098 | A * | 3/2001 | |
| WO | 0065103 | A2 | 11/2000 | |

OTHER PUBLICATIONS

ASTM E112 "Standard Test Methods for Determining Average Grain Size".
DIN EN 10351:2001-05 "Chemische Analyse von Eisenwerkstoffen—Analyse von unlegierten und niedrig legierten Stählen mittels optischer Emissionsspektrometrie mit induktiv gekoppeltem Plasma".
DIN EN 60404-13:2008-05 "Magnetische Werkstoffe—Teil 13: Prüfung zur Messung der Dichte, des spezifischen Widerstandes und des Stapelfaktors von Elektroblech und-band".
DIN EN 60404-2:2009-01 "Magnetische Werkstoffe—Teil 2: Verfahren zur Bestimmung der magnetischen Eigenschaften von Elektroband und-blech mit Hilfe eines Epsteinrahmens".
DIN EN ISO 6507-1:2006-03 "Metallische-Werkstoffe-Härte-Prüfung nach Vickers—Teil 1: Prüfverfahren".
DIN EN ISO 6892-1:2017-02 "Metallische Werkstoffe—Zugversuche—Teil 1: Prüfverfahren bei Raumtemperatur".
DIN EN ISO 7799:200-07 "Metallische Werkstoffe—Blech und Bänder mit einer Dicke von 3mm—Hin-und Herbiegeversuch".
German Office Action for DE Application No. 10 2017 208 146.5 dated Dec. 19, 2017.
German Office Action for DE Application No. 10 2017 208 146.5 dated Nov. 16, 2018.
International Search Report and Written Opinion for International Application No. PCT/EP2018/062185 dated Jul. 18, 2018.
Search Report of the First Office Action for CN Application No. 2018800323165 dated Nov. 27, 2020.

* cited by examiner

*Primary Examiner* — Jenny R Wu
(74) *Attorney, Agent, or Firm* — RMCK Law Group PLC

(57) ABSTRACT

The invention relates to a non-oriented electrical steel strip or sheet, in particular for electrical engineering applications, an electrical engineering component produced from such an electrical steel strip or sheet, a process for producing an electrical steel strip or sheet and the use of such an electrical steel strip or sheet in components for electrical engineering applications.

19 Claims, No Drawings

NON-ORIENTED ELECTRICAL STEEL STRIP FOR ELECTRIC MOTORS

CROSS-REFERENCE TO RELATED APPLICATIONS

This application is a 371 U.S. National Stage of International Application No. PCT/EP2018/062185, filed May 11, 2018, which claims priority to German Application No. 10 2017 208 146.5 filed on May 15, 2017. The disclosure of each of the above applications is incorporated herein by reference in their entirety.

TECHNICAL FIELD

The invention relates to a non-oriented electrical steel strip or sheet, in particular for electrical engineering applications, an electrical engineering component produced from such an electrical steel strip or sheet, a process for producing an electrical steel strip or sheet and the use of such an electrical steel strip or sheet in components for electrical engineering applications.

Non-oriented electrical steel strips or sheets, in technical language also referred to as "NO electrical steel strip or sheet" or else as "NGO electrical steel" ("NGO"=non-grain-oriented), are used for increasing the magnetic flux in iron cores of rotating electric machines. Typical uses of such steel sheets are electric motors and generators. Electric motors are, especially in electromobility applications, operated at relatively high rotational speeds, coupled to the associated relatively high frequencies. The losses occurring at these high frequencies are not comparable to the losses occurring at 50 Hz.

In order to increase the efficiency of such machines, very high rotational speeds or large diameters of the components which in each case rotate during operation are sought. As a consequence of this trend, the electrically relevant components made of electrical steel strips or sheets of the type in question here are subjected to high mechanical stress, which can often not be satisfied by the types of non-oriented electrical steel strip available at present. Furthermore, it is important and desirable, especially for use of the electrical steel strips or sheets in electric motors which are used in electric vehicles, for a high polarization to be present even at low field strengths so that the required high torque is ensured when starting up the electric vehicle. Furthermore, it is also necessary for a high polarizability to be achieved over the entire utilized rotational speed range of the electric motor. Furthermore, the core losses of the electric motor over the entire rotational speed range, which in turn is frequency-dependent, should be very low. The mechanical properties of the electrical steel strips and sheets should be improved compared to the materials known from the prior art; in particular, fewer negative influences on the soft-magnetic properties should result from the stamping process.

TECHNICAL BACKGROUND

EP 2 612 942 discloses a non-oriented electrical steel strip or sheet composed of a steel which contains, in addition to iron and unavoidable impurities, from 1.0 to 4.5% by weight of Si, up to 2.0% by weight of Al, up to 1.0% by weight of Mn, up to 0.01% by weight of C, up to 0.01% by weight of N, up to 0.012% by weight of S, from 0.1 to 0.5% by weight of Ti and from 0.1 to 0.3% by weight of P, where the ratio Ti content/P content, in each case in % by weight, obeys 1.0

Ti content/P content 2.0. The non-oriented electrical steel strip or sheet and components for electrical engineering applications made of such a strip or sheet display increased strengths and at the same time good magnetic properties. The non-oriented electrical steel strip or sheet of EP 2 612 942 is produced by cold-rolling a hot-rolled strip consisting of a steel having the abovementioned composition to give a cold-rolled strip and subsequently subjecting this cold-rolled strip to a final heat treatment. The polarizability at low frequencies and the mechanical properties of the electrical steel strips or sheets of EP 2 612 942 are still in need of improvement.

EP 2 840 157 discloses a non-oriented electrical steel strip or sheet, in particular for electrical engineering applications, produced from a steel which contains, in addition to iron and unavoidable impurities, from 2.0 to 4.5% by weight of Si, from 0.03 to 0.3% by weight of Si, up to 2.0% by weight of Al, up to 1.0% by weight of Mn, up to 0.01% by weight of C, up to 0.01% by weight of N, up to 0.001% by weight of S and up to 0.015% by weight of P, with ternary Fe—Si—Zr precipitates being present in the microstructure of the electrical steel strip or sheet. EP 2 840 157 also discloses a process for producing such electrical steel strips or sheets which includes a final heat treatment. The polarizability at low field strengths and the mechanical properties of the electrical steel strip of EP 2 840 157 are still in need of improvement.

WO 00/65103 A2 discloses a process for producing non-oriented electrical steel sheet, in which a steel intermediate containing less than 0.06% by weight of C, from 0.03 to 2.5% by weight of Si, less than 0.4% by weight of Al, from 0.05 to 1% by weight of Mn and less than 0.02% by weight of S is hot-rolled to give a hot-rolled strip having a thickness of less than 3.5 mm, subsequently pickled and after pickling is rolled to give a cold-rolled strip having a thickness of from 0.2 to 1 mm. The mechanical and magnetic properties of the electrical steel sheet of WO 00/65103 A2 are likewise in need of improvement.

DETAILED DESCRIPTION

It is therefore an object of the invention to provide electrical steel strips and sheets which when used in electric motors, which can preferably be used in electric vehicles, allow a high polarization even at low field strengths, so that a high torque is provided even when starting up the electric vehicle and at low rotational speeds. Furthermore, it is also necessary for a high polarization to be achieved both in the lower and relatively high field strength range over the entire utilized rotational speed range of the electric motor. Furthermore, the core losses when changing the rotational speed of the electric motor should be very low. The mechanical properties of the electrical steel strips and sheets should be improved compared to the materials known from the prior art; in particular, fewer negative influences on the soft-magnetic properties should result from the stamping process.

This object is achieved by a non-oriented electrical steel strip or sheet, in particular for electrical engineering applications, wherein the ratio of the polarization at a field strength of 100 A/m $J_{100}$ to the polarization at a field strength of 2500 A/m $J_{2500}$, in each case measured at 50 Hz, is at least 0.5, the electrical steel strip or sheet has a thickness of not more than 0.35 mm and the specific electrical resistance is from 0.40 to 0.70 μΩm at a temperature of 50° C., by a non-oriented electrical steel strip or sheet able to be produced, preferably produced, in a process comprising a final heat treatment at a temperature of from 950 to 1100° C. for not more than 90 s, by a process for producing the non-oriented electrical steel strip or sheet of the invention, comprising at least the following process steps: provision of a hot-rolled strip which consists of a steel which contains, in addition to iron and unavoidable impurities, from 2.3 to 3.40% by weight of Si, from 0.3 to 1.1% by weight of Al, from 0.07 to 0.250% by weight of Mn and up to 0.030% by weight of P and has a specific electrical resistance of from 0.40 to 0.70 μΩm at a temperature of 50° C., cold rolling of the hot-rolled strip to give a cold-rolled strip and final heat treatment of the cold-rolled strip, where the final heat treatment is carried out at a temperature of from 950 to 1100° C. for not more than 90 s, by a component for electrical engineering applications produced from an electrical steel strip or sheet according to the invention and by the use of an electrical steel strip or sheet according to the invention in components for electrical engineering applications.

A non-oriented electrical steel strip or sheet of the type according to the invention, in particular for electrical engineering applications, is preferably produced from a steel which contains from 2.30 to 3.40% by weight, preferably from 3.00 to 3.40% by weight, of Si, from 0.30 to 1.10% by weight, preferably from 0.60 to 1.10% by weight, of Al, from 0.07 to 0.25% by weight, preferably from 0.07 to 0.17% by weight, of Mn, up to 0.030% by weight of P and iron and unavoidable impurities as balance and has a specific electrical resistance preferably resulting therefrom of from 0.40 to 0.70 μΩm, particularly preferably from 0.42 to 0.65 μΩm, at a temperature of 50° C. The amounts of the individual elements present in the steel which is preferably used according to the invention are determined by methods known to those skilled in the art, for example by chemical analysis in accordance with DIN EN 10351: 2011-05 "Chemical analysis of ferrous materials—Inductively coupled plasma optical emission spectrometric analysis of unalloyed and low alloyed steels". According to the invention, P is present in a amount of up to 0.030% by weight, and P is preferably present at least in an amount of at least 0.005% by weight.

Possible impurities in the sense of the present invention are selected from the group consisting of C, S, Ti, N and mixtures thereof. The sum of the amounts of any impurities from the abovementioned group which are present should not exceed 100 ppm.

The inventors of the present invention have discovered that the demands made of an electrical steel strip or sheet at a frequency of 50 Hz cannot be compared with those at higher frequencies. We have therefore developed the electrical steel strip or sheet according to the invention and a process for the production thereof which result in advantages specifically for the frequency range 400-1000 Hz in order to achieve the objects of the invention.

In a preferred embodiment, the present invention provides the non-oriented electrical steel strip or sheet of the invention which has very small, specific grain sizes. Particular preference is given to a grain size of from 50 to 130 μm, preferably from 70 to 100 μm, being present in the electrical steel strip or sheet of the invention. The grain size of the electrical steel strip or sheet of the invention can be determined by all methods known to those skilled in the art, for example by examination of the microstructure by means of optical microscopy in accordance with ASTM E112 "Standard Test Methods for Determining Average Grain Size".

As a result of the small grain sizes which are preferably present according to the invention, the electrical steel strip or sheet of the invention firstly has the property of the influence of cold forming during processing of the strips or sheets by stamping being smaller at the stamping margins, so that no further process steps for working the stamping margins are necessary for use of the strips or sheets. Furthermore, the strips or sheets of the invention have particularly good soft-magnetic properties because of the small grain diameters, for example the magnetic properties are disrupted only in a very narrow strip immediately at the stamping margins. This property of the electrical steel strips or sheets of the invention is particularly advantageous in the case of very narrow webs in electric motors.

The non-oriented electrical steel strip or sheet of the invention also has particularly low core losses P. For the purposes of the present invention, the expression $P_{1.5/50}$ refers, for example, to the core loss P at a polarization of 1.5 T and a frequency of 50 Hz. The core losses P can according to the invention be determined by all methods known to those skilled in the art, in particular by means an Epstein frame, in particular in accordance with DIN EN 60404-2: 2009-01: "Magnetic materials—Part 2: Methods of measurement of the magnetic properties of electrical steel strip and sheet by means of an Epstein frame". There, appropriate electrical steel sheets are measured in the longitudinal (L), transverse (Q) or mixed direction (M).

In a preferred embodiment, the electrical steel strips or sheets of the invention have the following core losses, in each case values for the mixed direction (M):

In the case of $P_{1.5/50}$ 2.1-2.9 W/kg, particularly preferably 2.3-2.6 W/kg, in the case of $P_{1.0/400}$ 12.0-19.0 W/kg, particularly preferably 14.0-16 W/kg and/or in the case of $P_{1.0/2000}$ 110-250 W/kg, particularly preferably 170-210 W/kg.

According to the invention, it is particularly advantageous that the electrical steel strips or sheets of the invention have particularly low losses both at low frequencies and at high frequencies. This advantage of the invention is particularly advantageous when the electrical steel strips or sheets are used in electric motors for electric vehicles, since here the losses should be very low over the entire rotational speed range in operation.

According to the invention, the ratio $P_{10/400}/P_{1.5/50}$ is more preferably from 5.0 to 10.0, preferably from 5.7 to 8.0.

The non-oriented electrical steel strip or sheet of the invention also has a relatively high specific electrical resistance. Methods for determining the specific electrical resistance are known per se to a person skilled in the art, for example with the aid of a four-point measurement in accordance with DIN EN 60404-13: 2008-05 "Magnetic materials—Part 13: Methods of measurement of density, resistivity and stacking factor of electrical steel sheet and strip".

The non-oriented electrical steel strip or sheet of the invention has a specific electrical resistance of from 0.40 to 0.70 μΩm, preferably from 0.52 to 0.67 μΩm, in each case at a temperature of 50° C.

The non-oriented electrical steel strip or sheet of the invention, in particular for electrical engineering applications, has a ratio of the polarization at a field strength of 100 A/m $J_{100}$ to the polarization at a field strength of 2500 A/m $J_{2500}$, in each case measured at 50 Hz, of at least 0.50, preferably at least 0.53, particularly preferably at least 0.55. This ratio indicates that the polarization even at a low field strength of 100 A/m is at least 50%, preferably at least 53%, particularly preferably at least 55%, of the polarization at a high field strength of 2500 A/m. Methods of determining polarization and field strength are known to those skilled in the art, for example by means of an Epstein frame for determining the polarization, in particular in accordance with DIN EN 60404-2:2009-01: "Magnetic materials—Part 2: Methods of measurement of the magnetic properties of electrical steel strip and sheet by means of an Epstein frame".

Furthermore, the present invention preferably provides the non-oriented electrical steel strip or sheet of the invention, wherein the ratio of the polarization at a field strength of 100 A/m $J_{100}$ to the polarization at a field strength of 200 A/m $J_{200}$, in each case measured at 50 Hz, is from 0.59 to 1.0. This ratio means that the electrical steel strip or sheet of the invention even at a field strength of 100 A/m has from 59 to 100% of the polarization which it has at a field strength of 200 A/m.

The electrical steel strip or sheet of the invention has a thickness of not more than 0.35 mm. The present invention preferably provides the non-oriented electrical steel strip or sheet of the invention having a thickness of from 0.24 to 0.33 mm, particularly preferably from 0.25 to 0.32 mm, very particularly preferably from 0.26 to 0.31 mm, in each case with a deviation of up to 8%. According to the invention, the electrical steel strip or sheet preferably has particularly low thicknesses since the magnetic losses are lower at these low thicknesses than at greater thicknesses.

The non-oriented electrical steel strip or sheet of the invention preferably has a tensile strength of >480 N/mm$^2$, preferably >530 N/mm$^2$. Testing is carried out in the longitudinal direction of the material, i.e. in the rolling direction of the electrical steel strip, which is generally the poorer direction for the tensile strength because of anisotropy which may be present in the material. The tensile strength is determined according to the invention by methods known to those skilled in the art, for example tensile testing in accordance with DIN EN ISO 6892-1: 2017-02 "Metallic materials—Tensile testing—Part 1: Method of test at room temperature".

The present invention particularly preferably provides the non-oriented electrical steel strip or sheet of the invention which has a tensile strength Rm of from 450 to 600 N/mm$^2$.

The non-oriented electrical steel strip or sheet of the invention preferably has a yield strength of >350 N/mm$^2$, preferably >400 N/mm$^2$. The yield strength is determined according to the invention by methods known to those skilled in the art, for example tensile testing in accordance with DIN EN ISO 6892-1: 2017-02 "Metallic materials—Tensile testing—Part 1: Method of test at room temperature".

The present invention particularly preferably provides the non-oriented electrical steel strip or sheet according to the invention which has a yield strength Rp0.2 of from 330 to 480 N/mm$^2$.

The present invention more preferably provides the non-oriented electrical steel strip or sheet of the invention which has an elongation at break A80 of from 10 to 30.

The present invention more preferably provides the non-oriented electrical steel strip or sheet of the invention which has a hardness Hv5 of from 140 to 240.

The electrical steel strip or sheet of the invention preferably gains its positive properties as a result of the above-mentioned type of steel which is used. Furthermore, the electrical steel strip or sheet of the invention preferably gains the advantageous properties by means of the specific production process according to the invention, in particular as a result of the final heat treatment according to the invention.

For the purposes of the present invention, the "final heat treatment" is the heat treatment of the electrical steel strip or sheet according to the invention at the end of the production process, i.e. as last process step in the production process. According to the invention, it has been found that a particularly advantageous electrical steel strip or sheet is obtained when it is produced in a process comprising a final heat treatment at a temperature of from 950 to 1100° C. for not more than 90 s.

The present invention therefore also provides the non-oriented electrical steel strip or sheet which is able to be produced, preferably is produced, in a process comprising a final heat treatment at a temperature of from 950 to 1100° C. for not more than 90 s.

Processes for producing a non-oriented electrical steel strip or sheet are known per se to those skilled in the art. According to the invention, a final heat treatment is carried out at a temperature of from 950 to 1100° C., preferably from 980 to 1070° C., more preferably from 980 to 1050° C., for example 980° C. or 1050° C. According to the invention, the abovementioned temperatures during the final heat treatment can deviate upward by up to 20° C. and downward by up to 15° C.

The final heat treatment according to the invention is carried out for not more than 90 s, preferably for not more than 80 s, particularly preferably for not more than 70 s. The minimum duration of the final heat treatment is at least 10 s.

In general, the final heat treatment can be carried out in all ways known to a person skilled in the art. The final heat treatment is, according to the invention, preferably carried out in a continuously operated furnace through which the electrical steel strip or sheet is continuously passed, in particular in a horizontal continuous passage furnace.

A person skilled in the art will know that forces act on the electrical steel strip or sheet during final heat treatment as a result of strip moving devices used. However, according to the invention these forces should be very low. According to the invention, the forces should not exceed the creep strength.

It is preferred for the purposes of the invention that the above-described final heat treatment is carried out in one stage, not two stages. The present invention therefore preferably provides the non-oriented electrical steel strip or sheet which is produced by a single-stage final heat treatment. An advantage of the single-stage final heat treatment over a two-stage final heat treatment is, for example, that a heat treatment at relatively low temperatures is possible, i.e. the strip suffers from less oxidation.

An electrical steel strip which is particularly preferred according to the invention is obtained by using the above-mentioned particularly preferred type of steel comprising the abovementioned preferred alloying elements and treating the electrical steel strips or sheets produced in this way by means of the above-described final heat treatment. This particularly preferred combination according to the invention of the preferred inventive features gives an electrical steel strip or sheet which is particularly advantageous, in particular in respect of the further processing in a stamping process. The advantageous structure, in particular in respect of the grain size, results in little impairment of the magnetic and mechanical properties.

The production of the electrical steel strip or sheet of the invention is preferably carried out by the process described below.

The present invention therefore further provides a process for producing the non-oriented electrical steel strip or sheet of the invention, comprising at least the following process steps:

provision of a hot-rolled strip which consists of a steel containing

Si: from 2.30 to 3.40% by weight,

Al: from 0.30 to 1.10% by weight,

Mn: from 0.07 to 0.25% by weight,

P: up to 0.030% by weight, in addition to iron and unavoidable impurities, cold rolling of the hot-rolled strip to give a cold-rolled strip, and final heat treatment of the cold-rolled strip, where the final heat treatment is carried out at a temperature of from 950 to 1100° C. for not more than 90 s.

For this purpose, a hot-rolled strip having the composition explained above for the non-oriented electrical steel strip or sheet of the invention is first of all provided and is subsequently cold rolled and as cold-rolled strip subjected to a final heat treatment. The finally heat-treated cold-rolled strip obtained after the final heat treatment then represents the electrical steel strip or sheet having the composition and nature according to the invention, whose mechanical and magnetic properties are decisively improved compared to conventional NO electrical steel strips or sheets and which is therefore particularly suitable for producing electrical components and machines which in practical use are subjected to high dynamic loads and changing current frequencies and rotational speeds of the motor.

The production of the hot-rolled strip provided according to the invention can be carried out very largely conventionally. For this purpose, a steel melt having a composition corresponding to that prescribed by the invention can firstly be melted and cast to produce an intermediate which in the case of conventional manufacture can be a slab or thin slab.

The intermediate produced in this way can subsequently be brought to a temperature of the intermediate of from 1020 to 1300° C. For this purpose, the intermediate is if necessary reheated or kept at the respective target temperature by utilizing the heat of casting.

The intermediate which has been heated in this way can then be hot rolled to give a hot-rolled strip having a thickness which is typically from 1.5 to 4 mm, in particular from 2 to 3 mm. Hot rolling commences in a manner known per se at a hot rolling initial temperature in the ready-to-roll slab of from 1000 to 1150° C. and ends at a hot rolling final temperature of from 700 to 920° C., in particular from 780 to 850° C.

The hot-rolled strip obtained can subsequently be cooled to a reeling temperature and reeled up to give a coil. The reeling temperature is ideally selected so that problems in the cold rolling carried out subsequently are avoided. In practice, the reeling temperature is for this purpose not more than, for example, 700° C.

The hot-rolled strip provided is cold rolled to give a cold-rolled strip having a thickness which is typical of the thickness of the electrical steel strip or sheet of the invention, i.e. not more than 0.35 mm, preferably from 0.24 to 0.33 mm, particularly preferably from 0.25 to 0.32 mm, very particularly preferably from 0.26 to 0.31 mm, in each case with a deviation of up to 8%.

The concluding final heat treatment contributes decisively to improving the material properties, for example in favor of a higher strength or a lower core loss.

For the purposes of the present invention, a "final heat treatment" is the heat treatment of the electrical steel strip or sheet of the invention at the end of the production process, i.e. as last process step in the production process. The inventors of the present invention have found that a particularly advantageous electrical steel strip or sheet is obtained when it is produced in a process comprising a final heat treatment at a temperature of from 950 to 1100° C. for not more than 90 s.

According to the invention, a final heat treatment is carried out at a temperature of from 950 to 1100° C., preferably from 980 to 1070° C., more preferably from 980 to 1050° C., for example 980° C. or 1050° C. According to the invention, the abovementioned temperature during the final heat treatment can deviate upward by up to 20° C. and downward by up to 15° C.

The final heat treatment according to the invention is carried out for not more than 90 s, preferably for not more than 80 s, particularly preferably for not more than 70 s. The minimum duration of the final heat treatment is at least 10 s.

In general, the final heat treatment can be carried out in all ways which are known to those skilled in the art. The final heat treatment is, according to the invention, preferably carried out in a continuously operated furnace through which the electrical steel strip or sheet is passed continuously, in particular in a horizontal continuous-passage furnace.

A person skilled in the art will know that forces act on the electrical steel strip or sheet during the final heat treatment as a result of strip moving devices used. However, according to the invention these forces should be very low.

The present invention also provides a component for electrical engineering applications produced from an electrical steel strip or sheet according to the invention, preferably having a theoretical density of from 7.55 to 7.67 kg/cm$^3$. Examples of components for electrical engineering applications are electric motors, generators or transformers, in particular rotors or stators, which preferably represent basic components of an electric machine by means of which transformation of energy, in particular electric energy into mechanical energy, mechanical energy into electric energy or electric energy into electric energy, can be carried out.

The present invention further also provides for the use of an electrical steel strip or sheet according to the invention in components for electrical engineering applications, in particular in electric motors, generators or transformers, in particular rotors or stators which preferably represent basic components of an electric machine by means of which a transformation of energy, in particular electric energy into mechanical energy, mechanical energy into electric energy or electric energy into electric energy, can be carried out.

EXAMPLES

The invention is illustrated below with the aid of working examples.

Example: Samples P1 to P7

Electrical steel strips P1 to P7 according to the invention were produced from corresponding types of hot-rolled strip having the compositions shown in Table 1 and the data shown in Table 2.

TABLE 1

| Sample | C [%] | Mn [%] | P [%] | S [%] | Si [%] | Al [%] | N [%] | Ti [%] |
|---|---|---|---|---|---|---|---|---|
| P1 | 0.0026 | 0.194 | 0.015 | 0.0005 | 2.44 | 0.358 | 0.0018 | 0.0044 |
| P2 | 0.0020 | 0.154 | 0.009 | 0.0009 | 3.22 | 0.735 | 0.0023 | 0.0018 |

TABLE 1-continued

| Sample | C [%] | Mn [%] | P [%] | S [%] | Si [%] | Al [%] | N [%] | Ti [%] |
|---|---|---|---|---|---|---|---|---|
| P3 | 0.0030 | 0.158 | 0.012 | 0.0005 | 3.23 | 0.783 | 0.0010 | 0.0021 |
| P4 | 0.0014 | 0.153 | 0.009 | 0.0005 | 3.20 | 0.780 | 0.0011 | 0.0016 |
| P5 | 0.0023 | 0.143 | 0.150 | 0.0013 | 3.25 | 0.951 | 0.0013 | 0.0027 |
| P6 | 0.0020 | 0.156 | 0.010 | 0.0005 | 3.21 | 0.733 | 0.0016 | 0.0024 |
| P7 | 0.0017 | 0.155 | 0.012 | 0.0005 | 3.23 | 0.758 | 0.0014 | 0.0017 |

All percentages indicated are percent by weight.

TABLE 2

| Sample | HRS thickness [mm] | Cold-rolled strip thickness [mm] | SER at 50° C. [μΩm] | Theo. density [g/cm$^3$] |
|---|---|---|---|---|
| P1 | 1.80 | 0.304 | 0.459 | 7.67 |
| P2 | 2.14 | 0.298 | 0.596 | 7.58 |
| P3 | 2.10 | 0.302 | 0.604 | 7.58 |
| P4 | 2.00 | 0.303 | 0.600 | 7.58 |
| P5 | 2.00 | 0.293 | 0.647 | 7.55 |
| P6 | 2.00 | 0.266 | 0.595 | 7.58 |
| P7 | 2.00 | 0.284 | 0.601 | 7.58 |

HRS = hot-rolled strip;
SER = specific electrical resistance

TABLE 3

| Production parameters | | | | |
|---|---|---|---|---|
| Sample | Speed in continuous passage heat treatment [m/min.] | Time at >950° C. [s] | Time at >980° C. [s] | Time at >1000° C. [s] |
| P1 | 40 | 60 | 40 | — |
| P2 | 50 | 70 | 30 | 20 |
| P3 | 45 | 60 | 40 | 20 |
| P4 | 45 | 60 | 40 | 20 |
| P5 | 40 | 70 | 30 | 20 |
| P6 | 45 | 60 | 40 | 20 |
| P7 | 35 | 80 | 60 | 40 |

TABLE 4

| Magnetic properties, magnetic core losses | | | | | | | | |
|---|---|---|---|---|---|---|---|---|
| Sample | P1.0 200 Hz [W/kg] | P1.5 200 Hz [W/kg] | P1.0 400 Hz [W/kg] | P1.5 400 Hz [W/kg] | P1.0 700 Hz [W/kg] | P1.5 700 Hz [W/kg] | P1.0 1000 Hz [W/kg] | P1.5 1000 Hz [W/kg] |
| P1 | 7.07 | 17.1 | 19.1 | 47.1 | 46.2 | 116 | 80.2 | >180 |
| P2 | 5.89 | 13.5 | 15.5 | 37.1 | 44.2 | 89.5 | 62.9 | 162 |
| P3 | 5.75 | 13.3 | 15.2 | 36.4 | 35.4 | 88.0 | 62.1 | 159 |
| P4 | 5.86 | 13.5 | 15.5 | 36.8 | 43.9 | 88.3 | 62.6 | 160 |
| P5 | 5.91 | 13.7 | 15.1 | 36.3 | 34.8 | 87.0 | 60.8 | 157 |
| P6 | 5.52 | 13.2 | 14.1 | 35.1 | 39.6 | 82.6 | 55.8 | 148 |
| P7 | 5.51 | 13.5 | 14.8 | 37.8 | 43.0 | 91.5 | 61.2 | 166 |

TABLE 5

| Magnetic properties, magnetic polarization | | | | | |
|---|---|---|---|---|---|
| Sample | J100 50 Hz [T] | J200 50 Hz [T] | J2500 50 Hz [T] | J5000 50 Hz [T] | J10000 50 Hz [T] |
| P1 | 0.938 | 1.23 | 1.55 | 1.64 | 1.77 |
| P2 | 0.868 | 1.21 | 1.56 | 1.65 | 1.77 |
| P3 | 0.926 | 1.24 | 1.56 | 1.65 | 1.77 |
| P4 | 0.933 | 1.24 | 1.55 | 1.65 | 1.77 |
| P5 | 0.894 | 1.22 | 1.55 | 1.64 | 1.76 |
| P6 | 0.939 | 1.23 | 1.53 | 1.63 | 1.75 |

TABLE 5-continued

| Magnetic properties, magnetic polarization | | | | | |
|---|---|---|---|---|---|
| Sample | J100 50 Hz [T] | J200 50 Hz [T] | J2500 50 Hz [T] | J5000 50 Hz [T] | J10000 50 Hz [T] |
| P7 | 0.935 | 1.20 | 1.52 | 1.62 | 1.76 |

TABLE 6

| Mechanical properties | | | | | | |
|---|---|---|---|---|---|---|
| Sample | Rp0.2 [N/mm$^2$] | Rm [N/mm$^2$] | A80 | Hardness [HV5] | Grain diameter [μm] | Number of flexures |
| P1 | 350 | 480 | 26 | 160 | 80 | >10 |
| P2 | 460 | 580 | 19 | 205 | 60 | >10 |
| P3 | 440 | 570 | 23 | 202 | 80 | >10 |
| P4 | 445 | 555 | 20 | 200 | 85 | >10 |
| P5 | 450 | 570 | 21 | 205 | 80 | >10 |
| P6 | 420 | 545 | 13 | 195 | 80 | >10 |
| P7 | 420 | 540 | 16 | 190 | 120 | >10 |

The measured values presented were determined by the following methods:

Rp0.2:

The Rp0.2 value describes the yield strength of the material and is determined in accordance with DIN EN ISO 6892-1: 2017-02 "Metallic materials—Tensile testing—Part 1: Method of test at room temperature".

Rm:

The Rm value describes the tensile strength of the material and is determined in accordance with DIN EN ISO 6892-1: 2017-02 "Metallic materials—Tensile testing—Part 1: Method of test at room temperature".

Hv5:

The Hv5 value describes the hardness and is determined in accordance with DIN EN ISO 6507-1: 2006-03 "Metallic materials—Vickers hardness test—Part 1: Test method".

A80:

The A80 value describes the elongation at break and is determined in accordance with DIN EN ISO 6892-1: 2017-02 "Metallic materials—Tensile testing—Part 1: Method of test at room temperature".

Yield strength ratio:

The value for "yield strength value" describes the ratio Rp0.2/Rm and is determined in accordance with DIN EN ISO 6892-1: 2017-02 "Metallic materials—Tensile testing—Part 1: Method of test at room temperature".

Grain Diameter:

The grain diameter is determined by an examination of the microstructure by means of optical microscopy in accordance with ASTM E112 "Standard Test Methods for Determining Average Grain Size".

Polarization:

The polarization is determined in accordance with DIN EN 60404-2:2009-01: "Magnetic materials—Part 2: Methods of measurement of the magnetic properties of electrical steel strip and sheet by means of an Epstein frame".

Losses P:

The loss P is determined in accordance with DIN EN 60404-2:2009-01: Magnetic materials—Part 2: Methods of measurement of the magnetic properties of electrical steel strip and sheet by means of an Epstein frame".

Number of Flexures:

The number of flexures is determined in accordance with DIN EN ISO 7799: 200-07 "Metallic materials—Sheet and strip 3 mm thick or less—Reverse bending test".

INDUSTRIAL APPLICABILITY

The non-oriented electrical steel strip or sheet of the invention can preferably be used in electric motors, in particular for use in electric vehicles.

The invention claimed is:

1. A non-oriented electrical steel strip or sheet, wherein a ratio of a polarization at a field strength of 100 A/m $J_{100}$ to a polarization at a field strength of 2500 A/m $J_{2500}$, in each case measured at 50 Hz, is at least 0.5, wherein the electrical steel strip or sheet has a thickness of not more than 0.35 mm and a specific electrical resistance is from 0.40 to 0.70 μΩm at a temperature of 50° C.

2. The non-oriented electrical steel strip or sheet as claimed in claim 1, wherein the non-oriented electrical steel strip or sheet is produced from a steel containing Si: from 2.30 to 3.40% by weight, Al: from 0.30 to 1.10% by weight, Mn: from 0.07 to 0.25% by weight, P: up to 0.030% by weight, in addition to iron and unavoidable impurities.

3. The non-oriented electrical steel strip or sheet as claimed in claim 1 wherein the non-oriented electrical steel strip or sheet has a grain size of from 50 to 130 μm, preferably from 70 to 100 μm.

4. The non-oriented electrical steel strip or sheet as claimed in claim 2 wherein the non-oriented electrical steel strip or sheet has mixed values of $P_{1.5/50}$=2.1-2.9 W/kg, $P_{1.0/400}$<16 W/kg and $P_{1.0/2000}$<210 W/kg.

5. The non-oriented electrical steel strip or sheet as claimed in claim 1 wherein the specific electrical resistance is from 0.52 to 0.67 μΩm.

6. The non-oriented electrical steel strip or sheet as claimed in claim 1 wherein the ratio of the polarization at a field strength of 100 Nm $J_{100}$ to the polarization at a field strength of 200 Nm $J_{200}$, in each case measured at 50 Hz, is from at least 0.59 to 1.0.

7. The non-oriented electrical steel strip or sheet as claimed in claim 1 wherein the non-oriented electrical steel strip or sheet has a thickness of from 0.24 to 0.33 mm.

8. The non-oriented electrical steel strip or sheet as claimed in claim 1 wherein a yield strength Rp0.2 is from 330 to 480 N/mm$^2$.

9. The non-oriented electrical steel strip or sheet as claimed in claim 1 wherein a tensile strength Rm is from 450 to 600 N/mm$^2$.

10. The non-oriented electrical steel strip or sheet as claimed in claim 1 wherein an elongation at a break A80 has a value of from 10 to 30.

11. The non-oriented electrical steel strip or sheet as claimed in claim 1 wherein a hardness Hv5 has a value of from 140 to 240.

12. The non-oriented electrical steel strip or sheet as claimed in claim 1 wherein the non-oriented electrical steel strip or sheet is cold-rolled from a hot-rolled strip resulting in a decrease in thickness of between 83.1% and 86.7%.

13. The non-oriented electrical steel strip or sheet as claimed in claim 1 wherein the non-oriented electrical steel strip or sheet is produced from a steel containing Si: from 3.00% to 3.40% by weight.

14. The non-oriented electrical steel strip or sheet as claimed in claim 1 wherein the non-oriented electrical steel strip or sheet is produced from a steel containing Al: from 0.30% to less than 1.00% by weight.

15. The non-oriented electrical steel strip or sheet as claimed in claim 14 wherein the non-oriented electrical steel strip or sheet is produced from a steel containing Al: from 0.302% to 0.95% by weight.

16. A process for producing the non-oriented electrical steel strip or sheet as claimed in claim 1, consisting the following process steps:

provision of a hot-rolled strip which consists of a steel containing

Si: from 2.30 to 3.40% by weight,

Al: from 0.43 to 1.10% by weight,

Mn: from 0.07 to 0.250% by weight,

P: up to 0.030% by weight, in addition to iron and unavoidable impurities, cold rolling of the hot-rolled strip to give a cold-rolled strip, and final heat treatment of the cold-rolled strip, wherein the final heat treatment is carried out at a temperature of from 950 to 1100° C. for at least 10 seconds and not more than 90 seconds, thereby producing the non-oriented electrical steel strip or sheet of claim 1.

17. The process of claim 16 wherein the non-oriented electrical steel strip or sheet is produced from a steel containing Si: from 3.00% to 3.40% by weight.

18. The process of claim 16 wherein the non-oriented electrical steel strip or sheet is produced from a steel containing Al: from 0.30% to less than 1.00% by weight.

19. The process of claim 16 wherein the non-oriented electrical steel strip or sheet is produced from a steel containing Al: from 0.302% to 0.95% by weight.

* * * * *